United States Patent [19]

Irwin

[11] 4,311,098

[45] Jan. 19, 1982

[54] RAILWAY CAR TRUCK BOLSTER

[75] Inventor: Howard D. Irwin, Wilmington, Del.

[73] Assignee: E. I. DuPont de Nemours and Company, Wilmington, Del.

[21] Appl. No.: 122,725

[22] Filed: Feb. 19, 1980

[51] Int. Cl.[3] ..... B61F 1/00; B61F 5/16

[52] U.S. Cl. ..... 105/226

[58] Field of Search ..... 105/226–230

[56] References Cited

U.S. PATENT DOCUMENTS 566,546 8/1896 Stephan ..... 105/226

1,664,224 3/1928 Pinckney ..... 105/226

*Primary Examiner*—Richard A. Bertsch

[57] ABSTRACT

A railway car truck bolster is formed of channel cross section tension and compression members and a reinforced web joined together by welding to form a reinforced I-beam as the primary structural unit for the bolster. The welds joining the main structural elements are disposed to be stressed in shear rather than tension or compression for optimum fatigue performance.

2 Claims, 5 Drawing Figures

RAILWAY CAR TRUCK BOLSTER

BACKGROUND OF THE INVENTION

This invention relates to bolsters for railway car trucks and more particularly to bolsters of structural steel elements welded together.

Bolsters now in general use on railway car trucks are formed by casting. Cast steel bolsters tend to have flaws, difficult or impossible to detect by any means of inspection in common use by the foundries producing them. Flaws of the type present in these large castings are particularly detrimental to structural members, which are to serve in a fatique environment. Fatigue failures in these castings can lead to sudden and total loss of structural integrity resulting in derailment of the car in question and many others ahead and behind it in the train. There is a definite need in the rail industry for a properly welded bolster that can replace a cast bolster in an existing car which alleviates the problems associated with the fatigue conditions imposed by modern railway freight car operation and provides for an I-beam construction as the primary structural unit to permit easy inspection of the bolster.

SUMMARY OF THE INVENTION

A reinforced I-beam type railway car truck bolster comprising: a compression member horizontally extending the length of the bolster, said compression member having a centrally located center bearing; a tension member coextensive with said compression member and spaced therefrom, said tension member having an intermediate horizontal portion merging at opposite ends into diagonally and upwardly and outwardly extending portions, said compression and tension members being of U-shaped cross section with flanges of the respective members extending toward and in alignment with each other; and a reinforced web with access openings welded centrally between said compression member and said tension member to form an I-beam configuration for the cross section of said bolster. The web is reinforced by members welded to and extending from the compression member below the load points of the bearing to locations at opposite ends of intermediate horizontal portion of the tension member and by flanges welded to the perimeter of the access openings.

DETAILED DESCRIPTION OF THE PREFERRED EMBODIMENT

Figure 1:
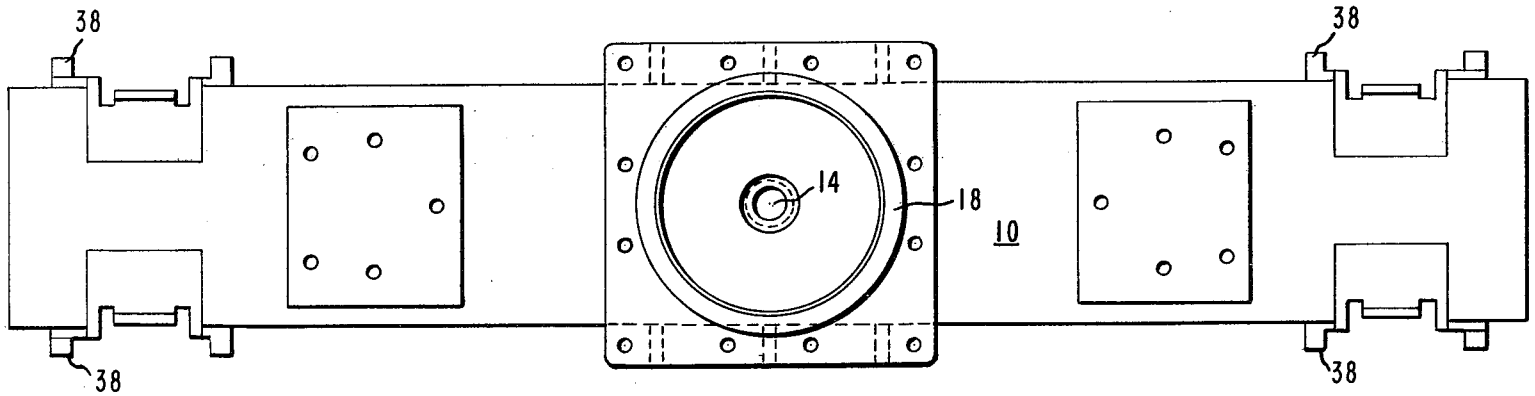
FIG. 1 is a top plan view of the truck bolster of this invention.
Figure 2:
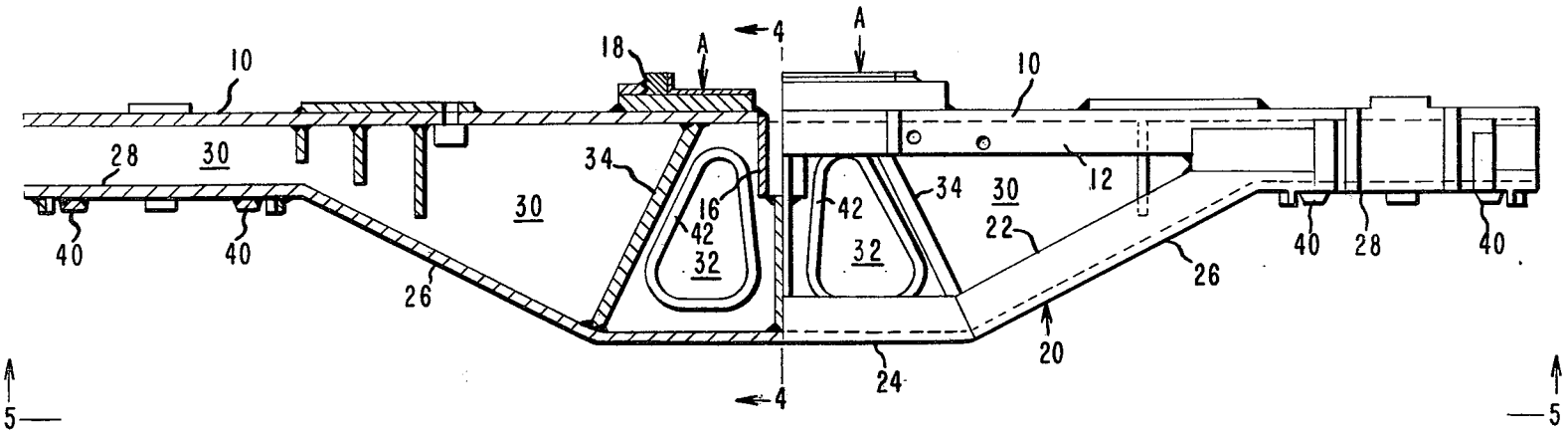
FIG. 2 is a partially sectioned side elevation view thereof.

Referring to the drawings, the truck bolster of this invention includes a compression member 10 having a U-shaped or channel cross section with side flanges 12. A central opening 14 in the compression member is surrounded on the lower side of the member 10 by a depending king pin receiving tube 16 which is welded to member 10. The top of member 10 is provided with an annular center plate 18 about opening 14 which is welded to member 10.

Figure 4:
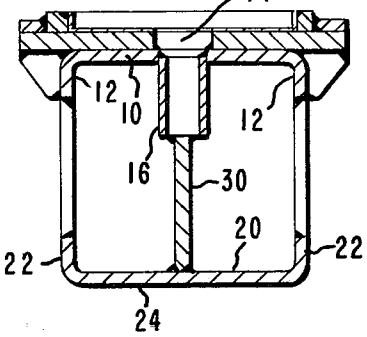
FIG. 4 is a vertical section view taken along line 4—4 of FIG. 2.

The tension member 20 of the bolster is spaced from the compression member 10 and has a U-shaped or channel cross section with side flanges 22. The tension member includes a central or intermediate portion 24 extending substantially horizontally the opposite ends of which merge into a pair of diagonally and upwardly and outwardly portions 26 which terminate in horizontal end portions 28. As shown in FIG. 4, the members 10,20 are disposed with their flanges 12,22 in alignment with and extending towarded each other.

The members 10,20 are joined together by a centrally located reinforced web 30 which is welded to each member. Web 30 is provided with access openings 32 for brake rods and is reinforced by stiffening members 34 welded between the web and tension and compression members which serve to transmit stresses to the tension member 20 from the compression member 10 due to loading of the center plate at the load points A which indicate line loads from a beveled car centerplate when the car rocks from one side to the other. Stiffening members 33 welded to web 30 connect tube 16 with the intermediate portion 24 of the tension member add extra strength to the bolster to carry center loads, e.g., when the car is not rocked. In addition, local bending fatigue loads are compensated for by flanges 42 which are bands located and welded to the perimeter of opening 32 so that the flanges extend out beyond both sides of web 30.

Figure 3:
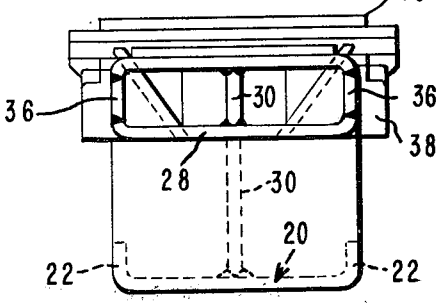
FIG. 3 is an end view of the truck bolster of this invention taken along line 3—3 of FIG. 5.
Figure 5:
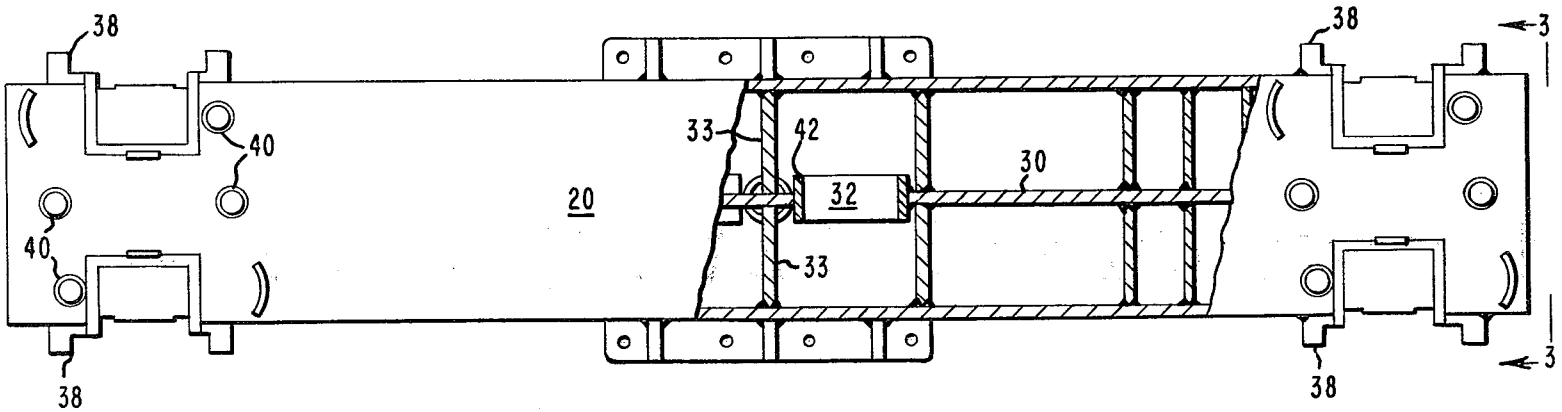
FIG. 5 is a partially sectioned bottom view of the truck bolster of this invention taken along line 5—5 of FIG. 2.

Referring to FIG. 3, it can be seen that the end portions of the bolster are boxed and provided with outer side walls 36, a top wall which is an extension of the compression member, and a bottom wall which is horizontal end portion 28 of the tension member all welded together. The bottom wall 28 of each end portion is provided with bolster spring centering lugs 40 and the other side walls 36 are provided with laterally disposed guides 38 for slidably engaging the columns of a truck side frame.

The bolster thus produced is able to resist all of the loadings to be encountered in service. The main structure on the top and bottom of the bolster is provided with turned flanges facing each other to resist fore and aft bending and the torsional loadings induced by unsymmetrical distribution of center plate loads in the fore and aft directions. The bolster is boxed at its extremities to resist these same torsional loads. In addition extra strength is provided at critical points with members 34 which connect to the compression member below the center plate bearing at load lines A and carry this load to web 30 and the tension member 20. There are no butt welds at critical load points and welds joining the main structural elements, i.e., compression member 10, tension member 20 and web 30, are so disposed to be stressed in shear rather than in tension or compression.

Further, the bolster described above can be readily inspected for damage which would render it unfit for service. The main structural welds are made readily available to easy visual inspection by the reinforced I-beam construction as the primary structural unit. This permits easy visual inspection of the main tension member as well. This ease of inspection is to be contrasted with presently used castings or box beam type fabricated bolsters where neither the critical welds nor the main tension members may be adequately inspected without complete disassembly of the truck.

I claim:

1. A reinforced I-beam type railway car truck bolster comprising: a compression member horizontally extending the length of the bolster, said compression member having a centrally located center bearing; a tension member coextensive with said compression member and spaced therefrom, said tension member having an intermediate horizontal portion merging at opposite ends into diagonally and upwardly and outwardly extending portions, said compression and tension members being of U-shaped cross section with flanges of the respective members extending toward and in alignment with each other; a web having access openings welded centrally between said compression member and said tension member to form an I-beam configuration for the cross section of said bolster; a plurality of welds joining the web, the compression member and the tension member, said welds being disposed to be stressed in shear rather than tension or compression; reinforcing members extending from said compression member below said center bearing at load points of line loads from a car centerplate engaging the center bearing when the car rocks from one side to the other to locations at the opposite ends of the intermediate horizontal portion of the tension member; and flanges welded to the perimeter of said access openings.

2. The truck bolster as defined in claim 1, wherein the bolster is provided with boxed in end portions having outer sidewalls, a top wall which is an extension of the compression member, and a bottom wall which is a horizontal end portion of the tension member.

* * * * *